US009920770B2

(12) United States Patent
Bennewa et al.

(10) Patent No.: US 9,920,770 B2
(45) Date of Patent: Mar. 20, 2018

(54) FLOW MACHINE

(71) Applicants: Carsten Bennewa, Oberhausen (DE); Hildegard Ebbing, Augsburg (DE); Emil Aschenbruck, Duisburg (DE)

(72) Inventors: Carsten Bennewa, Oberhausen (DE); Hildegard Ebbing, Augsburg (DE); Emil Aschenbruck, Duisburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 329 days.

(21) Appl. No.: 14/881,233

(22) Filed: Oct. 13, 2015

(65) Prior Publication Data

US 2016/0130962 A1 May 12, 2016

(30) Foreign Application Priority Data

Nov. 7, 2014 (DE) ..... 10 2014 016 476

(51) Int. Cl.

| | |
|---|---|
| ***F04D 29/54*** | (2006.01) |
| ***F04D 29/10*** | (2006.01) |
| ***F04D 29/52*** | (2006.01) |
| ***F04D 29/053*** | (2006.01) |
| ***F04D 29/056*** | (2006.01) |
| ***F04D 19/00*** | (2006.01) |
| ***F01D 11/00*** | (2006.01) |
| ***F01D 9/02*** | (2006.01) |
| ***F01D 25/16*** | (2006.01) |
| ***F01D 25/24*** | (2006.01) |
| ***F04D 29/12*** | (2006.01) |
| ***F04D 29/62*** | (2006.01) |
| ***F04D 29/64*** | (2006.01) |

(52) U.S. Cl.

CPC ..... *F04D 29/54* (2013.01); *F01D 11/003* (2013.01); *F04D 29/122* (2013.01); *F04D 29/624* (2013.01); *F04D 29/644* (2013.01); *F05D 2230/642* (2013.01)

(58) Field of Classification Search

CPC . F01D 9/02; F01D 11/00; F01D 25/16; F01D 25/243; F04D 19/002; F04D 29/053; F04D 29/056; F04D 29/102; F04D 29/522; F04D 29/54; F05D 2240/50; F05D 2240/55; F05D 2300/502

See application file for complete search history.

(56) References Cited

U.S. PATENT DOCUMENTS 2,221,225 A * 11/1940 Weis ..... F04D 29/126 277/361
4,054,293 A * 10/1977 Hoeg ..... F16J 15/42 277/347
4,243,230 A * 1/1981 Baker ..... F16J 15/406 277/387

(Continued)

*Primary Examiner* — Igor Kershteyn
(74) *Attorney, Agent, or Firm* — Cozen O'Connor

(57) ABSTRACT

A flow machine with a rotor-side shaft includes: a stator-side housing in which the rotor-side shaft is mounted; a seal bushing configured to seal a gap between the stator-side housing and the rotor-side shaft; a retaining bolt configured to center the seal bushing at the stator-side housing in a heat-resilient manner; and a clamp configured to fix the seal bushing in a positively engaging manner at the stator-side housing while ensuring a radial displaceability of the seal bushing relative to the stator-side housing.

8 Claims, 2 Drawing Sheets

(56) References Cited

U.S. PATENT DOCUMENTS

| | | | | | |
|---|---|---|---|---|---|
| 4,377,290 | A * | 3/1983 | Netzel | F16J 15/3484 | 277/368 |
| 5,531,564 | A * | 7/1996 | Anttonen | F04D 1/06 | 415/104 |
| 5,713,720 | A * | 2/1998 | Barhoum | F01D 3/04 | 415/104 |
| 6,884,031 | B2 * | 4/2005 | Gregory | F04D 1/063 | 415/199.2 |
| 8,047,549 | B2 * | 11/2011 | Kung | F16J 15/43 | 277/370 |

* cited by examiner

FLOW MACHINE

BACKGROUND OF THE INVENTION

1. Field of the Invention

The invention is directed to a flow machine.

2. Description of the Related Art

A flow machine constructed as a compressor and having a stator-side housing and a rotor-side shaft mounted in the housing is known from DE 10 2008 013 433 A1. This shaft carries rotor blades of the flow machine. For this reason, the rotor-side shaft is also known as rotor shaft. Further, it is known from DE 10 2008 013 433 A1 that a gap formed between the stator-side housing and the rotor-side shaft is sealed by at least one seal bushing.

An uneven temperature distribution is brought about at the structural component parts of a flow machine as a result of different operating conditions. Uneven temperature distributions lead to uneven deformations of structural component parts. In particular, the relatively thin-walled seal bushings used for sealing are especially sensitive to uneven deformations of structural component parts. Accordingly, the seal bushings tend to partially collapse viewed along the circumference such that the distance from the rotor-side shaft decreases. There is then the risk of contact between the rotor-side shaft and the stator-side seal bushing during operation, as a result of which the respective seal bushing is exposed to considerable wear.

Therefore, there is a need for a flow machine in which the risk of contact between rotor and stator is reduced even in the event of uneven temperature distributions at the structural component parts of the flow machine.

SUMMARY OF THE INVENTION

Therefore, it is an object of the present invention to provide a novel flow machine.

This object is met through a flow machine in which the respective seal bushing is centered at the housing in a heat-resilient manner in each instance by at least one retaining bolt and is fixed, in a positively engaging manner, at the housing by at least one clamp, while ensuring a radial displaceability of the respective seal bushing relative to the housing.

Through the combination of the retaining bolt, or each retaining bolt, with the clamp, or each clamp, the respective seal bushing can be centered at the housing in a heat-resilient manner in each instance on the one hand and can be fixed in a positively engaging manner at the housing on the other hand, namely while ensuring a radial displaceability of the respective seal bushing relative to the housing. In this way, the risk of the partial collapse of the respective seal bushing can be reduced so that the risk of contact between the rotor and stator is reduced. The positively engaging fixing of the respective retaining bushing at the housing by the clamps allows the respective seal bushing to be radially displaceable relative to the housing particularly so as to take into account a temperature-dependent deformation of the seal bushing and so that this deformation may be compensated.

The housing is preferably divided into an upper housing part and a lower housing part, and the respective seal bushing is fixed to the housing by positive engagement by two oppositely located clamps at a partial joint area located in the dividing area of the housing. The arrangement of the clamps in the partial joint area of the flow machine at two oppositely located positions is advantageous for preventing the partial collapse of the respective seal bushing and, therefore, for reducing the risk of contact between rotor and stator.

According to an advantageous further development, the respective clamp engages, by positive engagement, in a recess of the housing by a first projection, engages, by positive engagement, in a recess of the respective retaining bolt by a second projection and engages in a recess of the respective seal bushing by a third projection, and the radial dimensioning of the recess of the respective seal bushing is greater than the radial dimensioning of the third projection so as to ensure the radial displaceability of the respective seal bushing relative to the housing. This arrangement of the respective clamps is simple and allows the respective seal bushing to be fixed to the housing by positive engagement in an efficient manner.

According to an advantageous further development, a first fastening screw extends into the housing through the respective clamp and the respective retaining bolt. A second fastening screw preferably extends into the housing exclusively through the respective clamp. The fastening screws are particularly preferred for fixing the retaining bolts and respective clamps to the housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are indicated in the following description. Without limiting generality, embodiment examples of the invention will be described more fully with reference to the drawings, in which.

DETAILED DESCRIPTION OF THE PRESENTLY PREFERRED EMBODIMENTS

The invention is directed to a flow machine, particularly a turbine or expander. However, the flow machine according to the invention can also be constructed as a compressor.

A flow machine according to the invention comprises a stator-side housing and a rotor-side shaft mounted in the stator-side housing. The rotor-side shaft carries rotor blades and, for this reason, the rotor-side shaft of a flow machine is also known as a rotor shaft. A gap formed between the rotor-side shaft and the stator-side housing is sealed by sealing elements. Typically, seal bushings are used as sealing elements. The present invention is directed to a particularly advantageous fastening of a seal bushing of this type to the stator-side housing of the flow machine in order to prevent the risk of contact between rotor and stator, namely the risk of the rotor-side shaft running into the stator-side seal bushing fastened to the stator-side housing.

Figure 1:
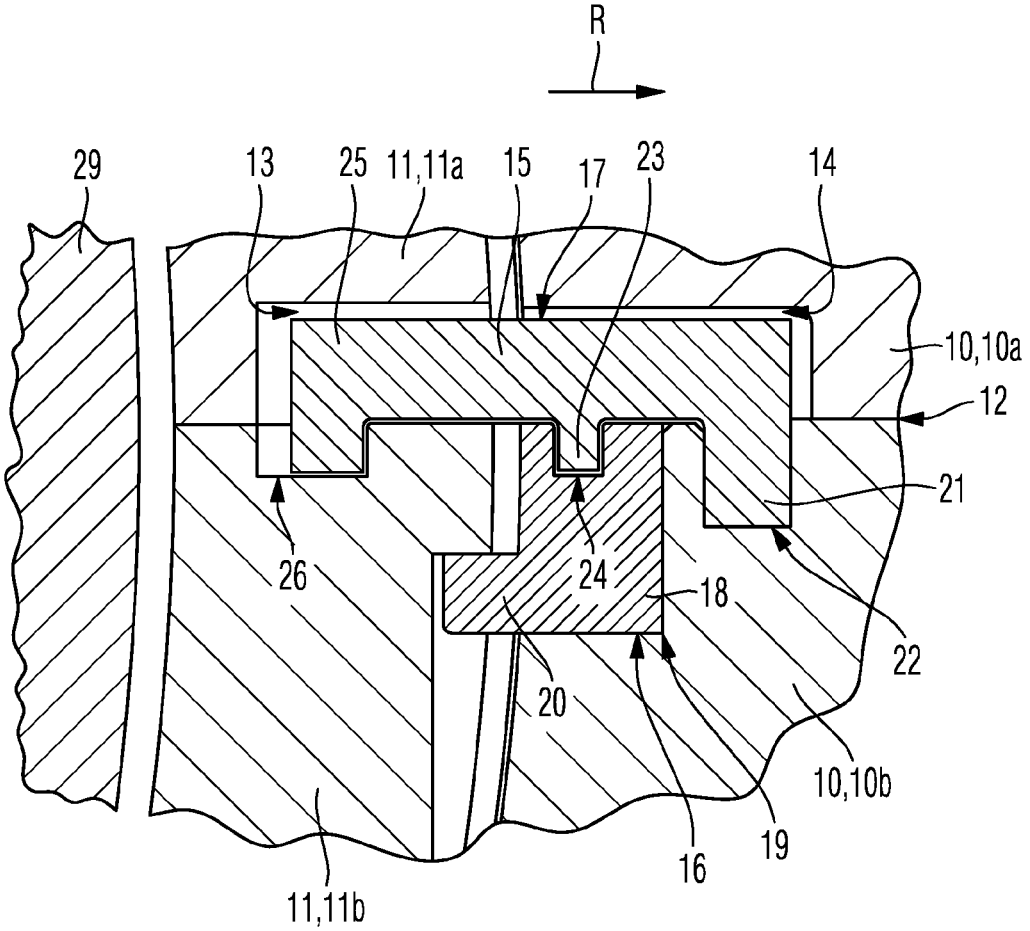
FIG. 1 shows a first fragmentary cross section through a flow machine according to the invention.
Figure 2:
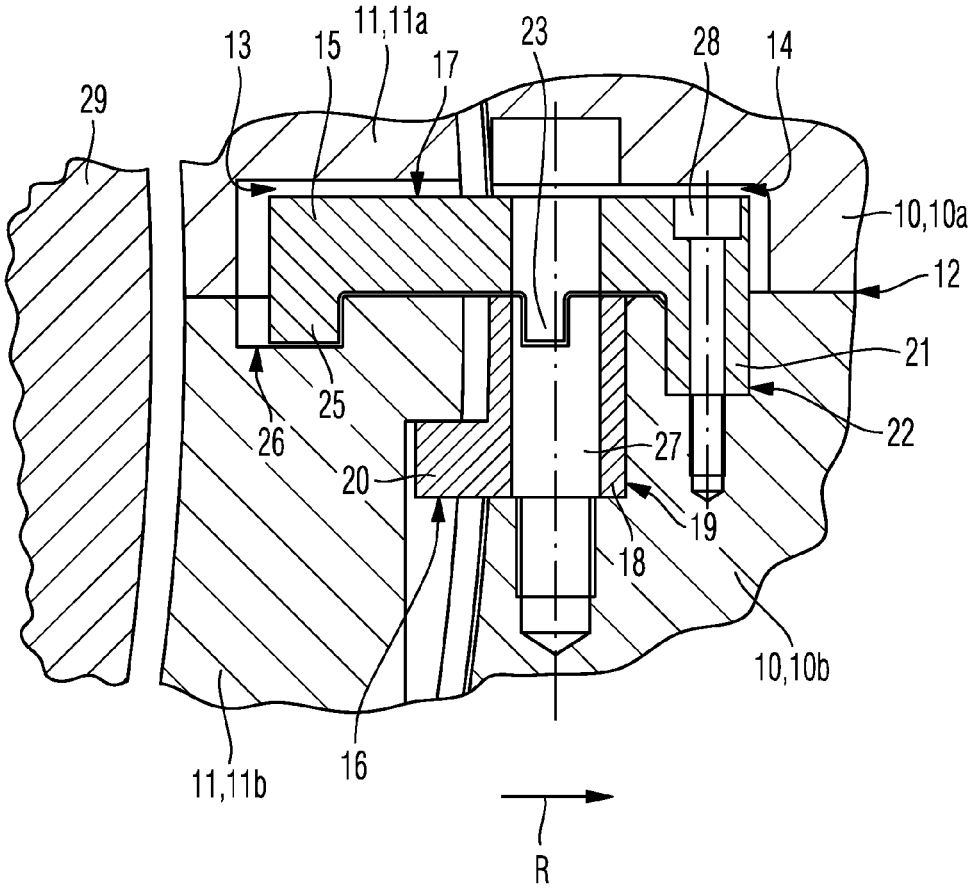
FIG. 2 shows a second, offset fragmentary cross section through a flow machine according to the invention.

FIGS. 1 and 2 each show a section from a flow machine in the region of a housing 10 and a seal bushing 11 mounted at the housing 10. The housing 10 and seal bushing 11 are divided along a dividing plane 12 so as to form an upper housing part 10*a*, a lower housing part 10*b*, an upper seal bushing part 11*a* and a lower seal bushing part 11*b*. The seal bushing 11 shown in section in FIGS. 1 and 2 is mounted at the housing 10, also shown in section, specifically through the use of at least one retaining bolt 16 and at least one clamp 17. Preferably, the seal bushing 11 is fitted to the housing 10 in the region of the separation plane 12 and, therefore, at a partial joint area of the seal bushing 11 located in the junction or separation plane 12 of the housing 10 and seal bushing 11 at two preferably diametrically opposed positions. A retaining bolt 16 and a clamp 17 are used at each of these positions.

The seal bushing 11 is centered in a heat-resilient manner at the housing 10 via the retaining bolts 16. A base body 18 of the respective retaining bolt 16 is received in a corresponding recess 19 in the housing 10. A projection 20, which projects radially inwardly opposite this base body 18, extends into the seal bushing 11 so as to center the seal bushing 11 at the housing 10 in a heat-resilient manner.

The respective clamp 17 serves to fix the seal bushing 11 to the housing 10 in a positively engaging manner, namely while ensuring a radial displaceability of the respective seal bushing 11 relative to the housing.

The respective clamp 17 has a plurality of projections, namely a first projection 21 by which the clamp 17 engages, by positive engagement, in a recess 22 of the housing 10, a second projection 23 by which the respective clamp 17 engages, by positive engagement, in a recess 24 of the respective retaining bolt 16 which is formed in the base body 18 thereof, and a third projection 25, which engages in a recess 26 of the seal bushing 11. The dimensioning of this recess 26 in radial direction R is greater than the radial dimensioning of the third projection 25 in order to ensure the radial displaceability of the respective seal bushing 11 relative to the housing 10.

Projections 21, 23 and 25 protrude opposite the respective clamp 17 so as to form a clamp 17 with an E-shaped contour at one side of a base body 15 of the respective clamp 17, which base body 15 extends in radial direction. According to FIG. 1, projection 21 of the respective clamp 17 extends into the recess 22, which is formed in the lower housing part 10*b* of the housing 10, and projection 25 of the respective clamp 17 extends into a recess 26, which is formed in the lower seal bushing part 11*b* of the seal bushing 11.

The retaining bolt 18 projects into a recess 19 in the lower housing part 10*b* of the housing 10. Projection 23 of clamp 17 engages in recess 24 of retaining bolt 18 by positive engagement. The radially extending base body 15 of the respective holding clamp 17 is received in recesses 13, 14 of upper seal bushing part 11*a* and upper housing part 10*a*.

In the depicted embodiment example, the clamp 17 is fixed to the housing 10 by two fastening screws 27, 28. A first fastening screw 27 extends through the respective clamp 17 and the respective retaining bolt 16 into the housing 10, namely the lower housing part 10*b*. A second fastening screw 28 extends into the lower housing part 10*b* only through the clamp 17. The first fastening screw 27 is positioned in an area in which the second projection 23 of the clamp 17 is also formed. The second fastening screw 28 extends in the same region of the clamp 17 in which the first projection 21 is formed.

Accordingly, in the flow machine 10 according to the invention, the seal bushing 11, or each seal bushing 11, which serves to seal a gap between the housing 10 and a rotor shaft, not shown, is fitted preferably in the partial joint area and, accordingly, in the region of a separation plane 12 between the upper housing part 10*a* and the lower housing part 10*b*, at preferably two positions diametrically opposite one another at the rotor-side shaft by a clamp 17 and a retaining bolt 16, namely in a positively engaging manner while ensuring a radial displaceability of the respective seal bushing 11 with respect to the housing 10. In this way, the tendency of the respective seal bushing 11 to deform unevenly along its circumference due, for example, to transient operating conditions or uneven temperature distributions over the structural component parts of the flow machine can be prevented. Contact between rotor and stator can accordingly be prevented in a simple manner. In particular, the rotator-side shaft can be prevented from partially running into the stator-side seal busing 11 as the result of a partial collapse of the respective seal bushing 11.

When a clamp 17 and a retaining bolt 16 are used at two diametrically opposite positions in the partial joint region, they are constructed identically at the diametrically opposite positions.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMERALS

10 housing
10*a* upper housing part
10*b* lower housing part
11 seal bushing
11*a* upper seal bushing part
11*b* lower seal bushing part
12 separation area
13 recess
14 recess
15 base body
16 retaining bolt
17 clamp
18 base body
19 recess
20 projection
21 projection
22 recess
23 projection
24 recess
25 projection
26 recess
27 fastening screw

What is claimed is:

1. A flow machine with a rotor-side shaft, the flow machine comprising:

a stator-side housing (10) in which the rotor-side shaft is mounted;

a seal bushing (11) configured to seal a gap between the stator-side housing (10) and the rotor-side shaft;

a retaining bolt (16) configured to center the seal bushing (11) at the stator-side housing (10) in a heat-resilient manner; and a clamp (17) configured to fix the seal bushing (11) in a positively engaging manner at the stator-side housing (10) while ensuring a radial displaceability of the seal bushing (11) relative to the stator-side housing (10).

2. The flow machine according to claim 1, wherein the clamp (17) has:

a first projection (21) configured to engage, by positive engagement, in a housing recess (22) of the stator-side housing (10);

a second projection (23) configured to engage, by positive engagement, in a retaining bolt recess (24) of the retaining bolt (16); and a third projection (25) configured to engage in a seal bushing recess (26) of the seal bushing (11), wherein a radial dimensioning of the seal bushing recess (26) of the seal bushing (11) is greater than a radial dimensioning of the third projection (25) so as to ensure the radial displaceability of the seal bushing (11) relative to the stator-side housing (10).

3. The flow machine according to claim 2, wherein the clamp (17) has a base body (15) extending in a radial direction and the first, second and third projections (21, 23, 25) protrude in relation to the base body (15) such that the clamp (17) has an E-shaped contour at one side of the base body (15) of the clamp (17).

4. The flow machine according to claim 1, wherein the stator-side housing (10) is divided into an upper housing part (10*a*) and a lower housing part (10*b*), and the seal bushing (11) is fixed to the stator-side housing (10), by positive engagement, by the clamp (17) and an oppositely located second clamp (17) at a partial joint area located in a dividing area (12) of the stator-side housing (10).

5. The flow machine according to claim 4, wherein the clamps (17) are diametrically opposed in the partial joint area.

6. The flow machine according to claim 1, further comprising a first fastening screw (27) configured to extend into the stator-side housing (10) through the clamp (17) and the retaining bolt (16).

7. The flow machine according to claim 6, wherein a second fastening screw (28) extends into the stator-side housing (10) exclusively through the clamp (17).

8. The flow machine according to claim 1, wherein the flow machine is a turbine.

* * * * *